US012016477B1

(12) United States Patent
Wong

(10) Patent No.: US 12,016,477 B1
(45) Date of Patent: Jun. 25, 2024

(54) MULTIFUNCTIONAL STORAGE CLIP

(71) Applicant: Ching Man Wong, Hong Kong (CN)

(72) Inventor: Ching Man Wong, Hong Kong (CN)

( * ) Notice: Subject to any disclaimer, the term of this patent is extended or adjusted under 35 U.S.C. 154(b) by 0 days.

(21) Appl. No.: 18/234,581

(22) Filed: Aug. 16, 2023

(51) Int. Cl.
*A47G 25/10* (2006.01)
*A45F 5/00* (2006.01)

(52) U.S. Cl.
CPC ..... *A47G 25/10* (2013.01); *A45F 5/00* (2013.01); *A45F 2200/0541* (2013.01); *A47G 2200/106* (2013.01)

(58) Field of Classification Search
CPC ..... A47G 25/10; A47G 2200/106; A45F 5/00; A45F 2200/0541; A45F 5/06; Y10S 248/902; Y10T 24/1371; Y10T 24/32; Y10T 24/44222; Y10T 24/44231
See application file for complete search history.

(56) References Cited

U.S. PATENT DOCUMENTS 374,702 A * 12/1887 Rand ..... G02C 11/00 24/336
392,363 A * 11/1888 Riggs ..... G02C 11/00 24/363
3,529,328 A * 9/1970 Davison ..... A47G 25/485 24/303
4,336,806 A * 6/1982 Eldridge, Jr. ..... A61M 25/02 248/205.3
9,565,879 B2 * 2/2017 LaHann ..... A41D 1/215
10,413,047 B2 * 9/2019 Albanese ..... A45C 13/30
2010/0157237 A1 * 6/2010 Mor ..... G02C 3/04 351/155
2015/0150312 A1 * 6/2015 LaHann ..... A41F 1/002 24/465
2018/0368602 A1 * 12/2018 Albanese ..... A44B 13/02
2019/0290041 A1 * 9/2019 Albanese ..... A47G 25/10
2020/0085192 A1 3/2020 Wartchow
2022/0240631 A1 8/2022 Ferrari

FOREIGN PATENT DOCUMENTS

WO WO-9423409 A1 * 10/1994 ..... G09F 1/10

* cited by examiner

*Primary Examiner* — Rodney Mintz
(74) *Attorney, Agent, or Firm* — Birchwood IP

(57) ABSTRACT

The present disclosure relates to the technical field of storage clips, and discloses a multifunctional storage clip. The storage clip is made of an elastic material, and a middle of the storage clip is soft and foldable. An inner hole is provided near a middle position, and a half of the storage clip is pierced out of the inner hole to achieve interlocking. After interlocking, three functional areas can be achieved, which are an upper hanging area and a middle is additionally provided with a soft adhesive strip, one end is fixed with a first hook, and one end is provided with through holes having multiple spacings from a fixed position. The through holds are combined with the first hook to achieve a function of storing glasses with different sizes. Two magnets with strong strength are respectively provided at two tail ends.

7 Claims, 7 Drawing Sheets

MULTIFUNCTIONAL STORAGE CLIP

CROSS-REFERENCE TO RELATED APPLICATIONS

This is a U. S. patent application which claims the priority and benefit of Chinese Patent Application Number 202322049910.6, filed on Aug. 1, 2023, the disclosure of which is incorporated herein by reference in its entirety.

TECHNICAL FIELD

The present disclosure relates to the field of storage clip technologies, and in particular, to a multifunctional storage clip.

BACKGROUND

With the increasing improvement of people's living standards, outdoor activities or long-distance travel have become a popular leisure way for the public, and the demand for sunshade products such as hats and sunglasses has also increased. The hats and sunglasses not only have a function of shading, but also are synonymous of fashion with various styles; random placement the hats and sunglass will easily cause a deformation of the hat, deformation or breakage of a holder of the sunglass, and a storing of hats and sunglasses has become a new demand when going out. At present, there is a hat clip product with a single function in the market, which is implemented hanging through simply folding and a magnet added at a tail end of the hat clip to grip a brim of the hat. However, when the size of the hat that is hanged is bigger, a reverse tension of the magnet at the tail end that adsorbs on the hat clip increases, and an adsorption force of the magnet at the tail end weakens. And thus, this type of hat clip is easy separated due to an external force, causes the hat to fall off, be unable to adapt to various sizes of hanging carriers, and the function is single.

SUMMARY

A main objective of the present disclosure is to provide a multifunctional storage clip aiming to solve a problem that the existing hat clip cannot adapt to various sizes of hanging carriers and add a function of storing sunglass on the basis of the existing hat clip with a single storage function. When the size of the hanging carrier exceeds a hanging diameter of the hat clip, the hat clip will be stretched out integrally, lose its original clamping force, and a hat will be loosened.

To achieve the above objective, the present disclosure provides a multifunctional storage clip, including a storage clip body; an inner hole located near a middle area of the storage clip body; an inner concave buckle symmetrically arranged with the inner hole; a magnetic magnet wrapped inside an tail end of the storage clip body; a soft adhesive strip provided on a surface of the storage clip body; a first hook, configured to fix the soft adhesive strip when it reverse bending; and a second hook, configured to fix the soft adhesive strip when it forward bending.

In an implementation, the storage clip body is made of an elastic material, such as, silicone, rubber, TPU (Thermoplastic Polyurethane), elastic cloth, polyurethane, etc.

In an implementation, the soft adhesive strip is made of an elastic material, such as, silicone, rubber, TPU, elastic cloth, polyurethane, etc.

In the technical solution provided by the present disclosure, an elastic material is used, and an inner hole and an inner concave buckle are respectively provided near a middle position of the storage clip body. One end of a half of the storage clip body is pierced out of the inner hole, and the inner concave buckle is combined to buckle two walls of the inner hole to prevent rebound and thus forming a closed loop. Combined with a flexibility of the elastic material, it can adapt to various sizes of hanging carriers without easily loosening. This design is separated from a clamping area at a tail end that is clamped through a magnetic force and not affected by each other. Two magnets with strong strength are provided at two tail ends of the storage clip body, respectively. After the storage clip is folded in half, south and north poles of the magnets at two ends are opposite to each other, and a clamping force is achieved through a magnetic adsorption; at the same time, a local protrusion is added on a clamping surface to enhance an anti-slip effect and improve a firmness of storing a brim of a hat, Besides that, a soft adhesive strip is provided in a middle position of the storage clip after the storage clip is folded in half, one end of the soft adhesive strip is fixed to the storage clip body with a first hook, and the other end of the soft adhesive strip is provided with multiple through holes having different spacings from the first hook. When it is necessary to store glasses, the soft adhesive strip is reverse bent to wrap a bracket of glasses, and the through holes at tail end are buckled into the first hook for fixation, thereby achieving a function of storing glasses when it is not in use. The design of through holes with different spacings is used to meet requirements of different sizes of glasses brackets. This design enhances a traditional function of the hat clip, achieves multiple functions, and extends applicability in various scenarios.

BRIEF DESCRIPTION OF DRAWINGS

One or more embodiments are illustrated with corresponding drawings, which do not constitute a limitation of the embodiments. Elements with the same reference numerals in the drawings represent similar elements, unless otherwise stated, and the figures in the drawings do not constitute a limitation of proportion.

Figure 1A:
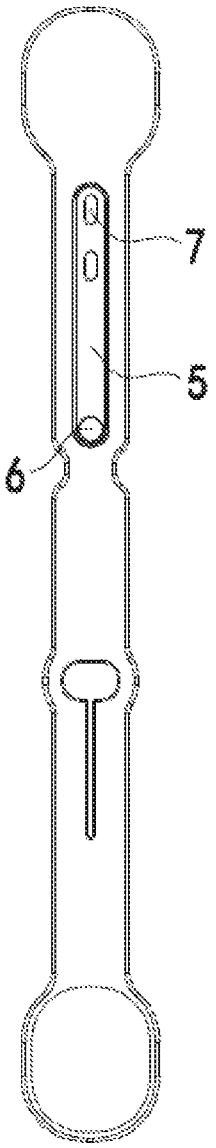
FIGS. 1A, 1B and 1C are expansion diagrams of a storage clip of an embodiment of the present disclosure.

Numeral reference: 1. Storage clip body; 2. Inner hole; 3. Inner concave buckle; 4. Magnetic magnet; 5. Soft adhesive strip; 6. First hook; 7: Second hook.

DETAILED DESCRIPTION

The following will provide a clear and complete description of the technical solution in the embodiment of the present disclosure in combination with the drawings. Obviously, the described embodiments are only a part of the embodiments of the present disclosure, not all of them.

The example in the embodiment is shown in the drawings, where the same or similar numeral reference throughout indicate the same or similar elements or components with the same or similar functions. The embodiment described below with reference to the drawings is exemplary and intended to explain the present disclosure, but cannot be understood as limitations to the present disclosure.

Figure 1B:
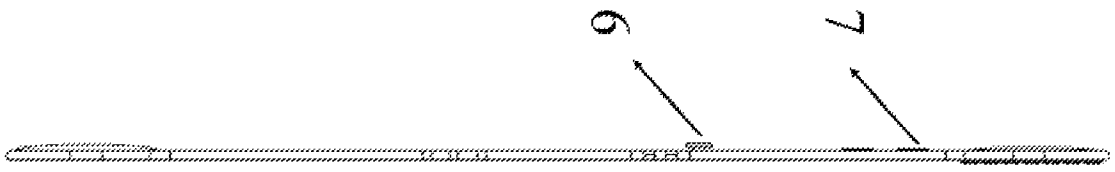
Figure 1C:
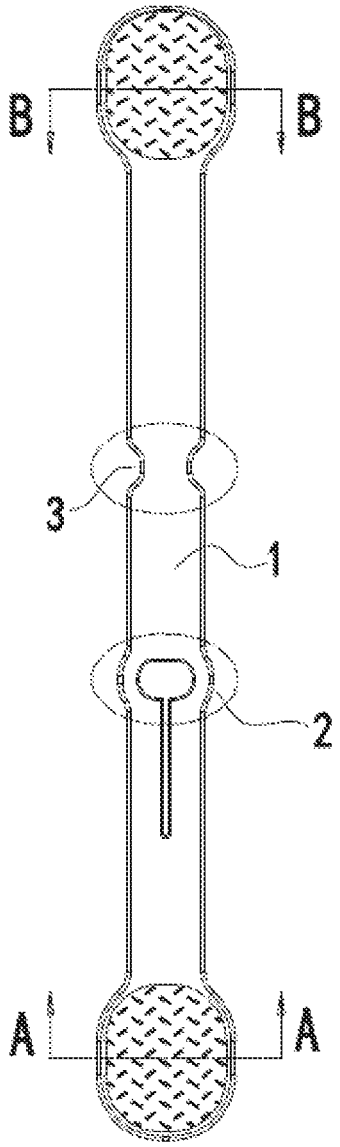
Figure 2:
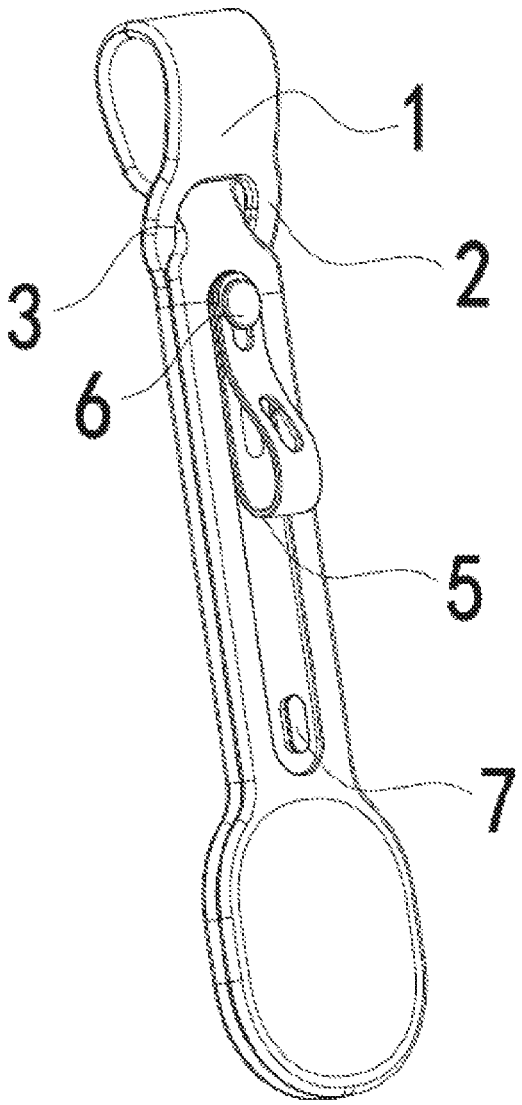
FIG. 2 is a schematic diagram of the storage clip body being folded in half, buckled, and piercing out of an inner hole of an embodiment of the present disclosure.
Figure 3:
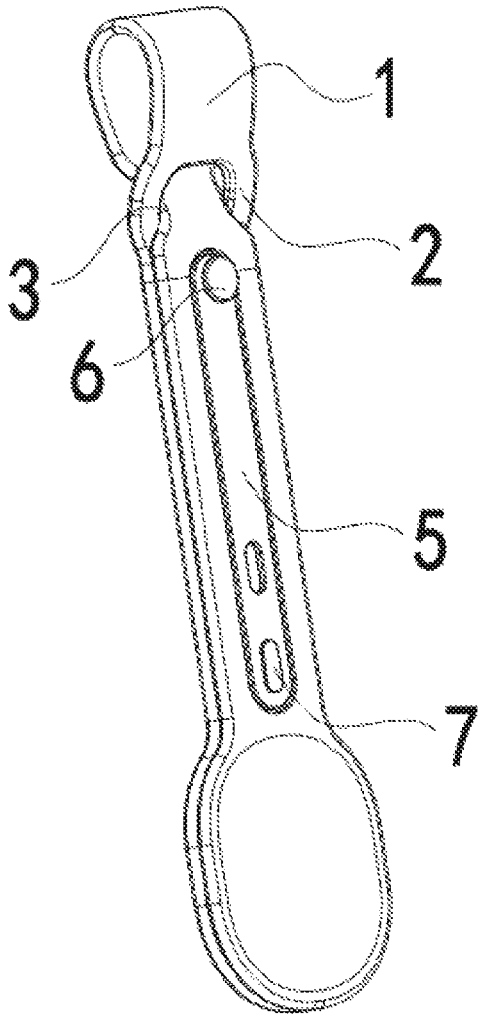
FIG. 3 is a schematic diagram of a soft adhesive strip being bent and fixed in an inner concave buckle of an embodiment of the present disclosure.
Figure 4A:
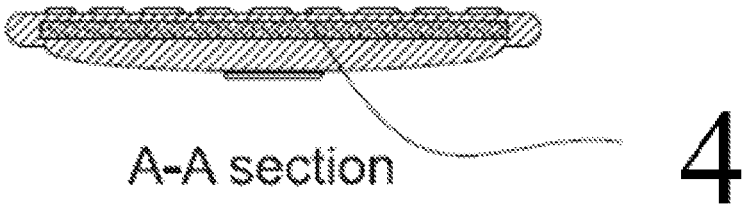
FIGS. 4A and 4B are A-A and B-B section& diagrams of FIG. 1C.
Figure 4B:
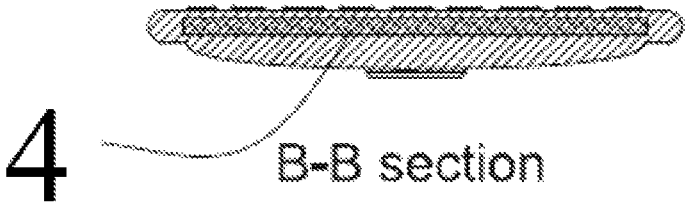
Figure 5:
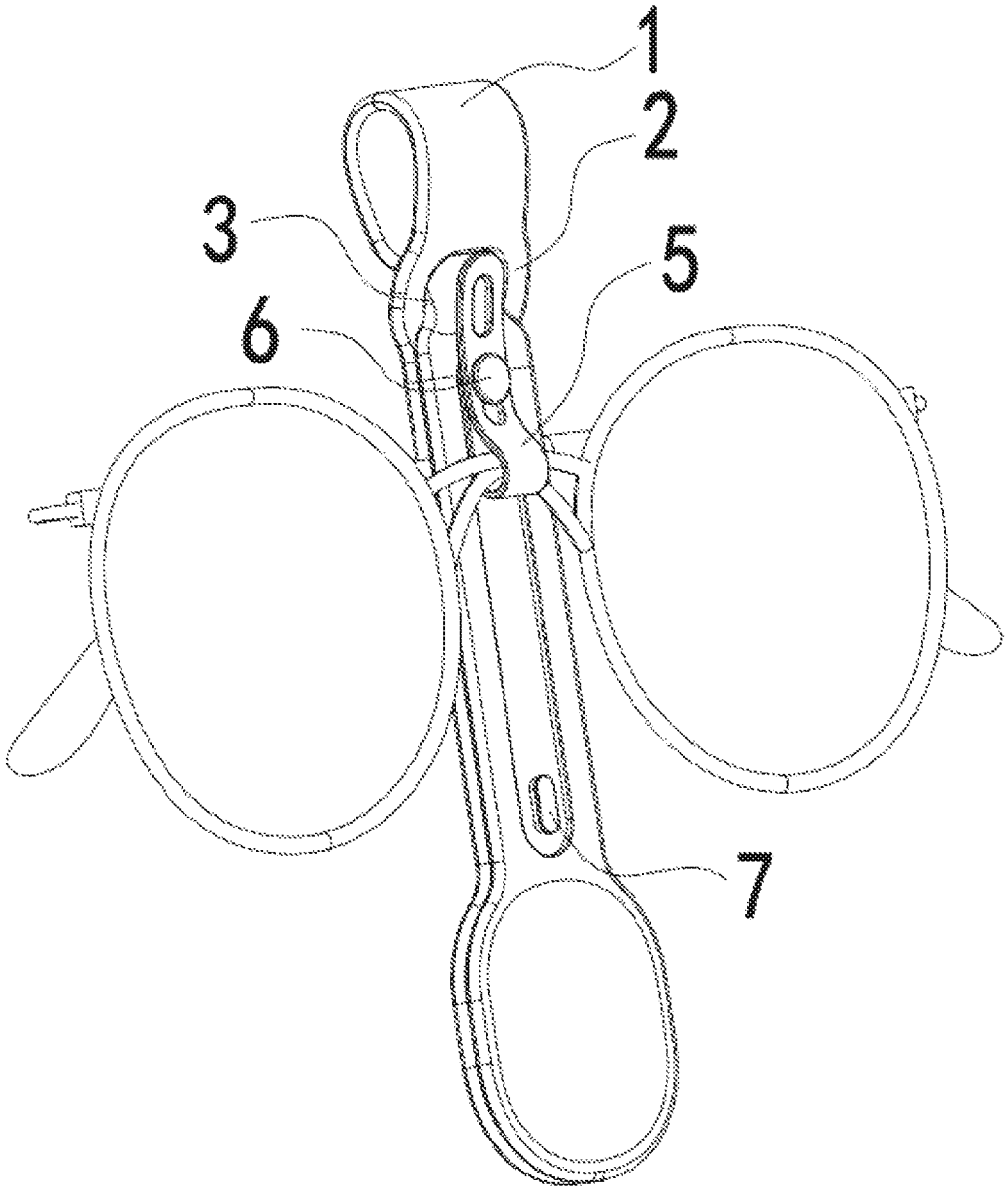
FIG. 5 is a schematic diagram of storing glasses of an embodiment of the present disclosure.

Please refer to FIGS. 1A, 1B, 1C, 2, and 3, a multifunctional storage clip includes a storage clip body (1); an inner hole (2) located near a middle area of the storage clip body (1); an inner concave buckle (3) symmetrically arranged with the inner hole (2); a magnetic magnet (4) wrapped inside an tail end of the storage clip body (1); a soft adhesive strip (5) provided on a surface of the storage clip body (1); a first hook 1 (6), configured to fix the soft adhesive strip (54) when it reverse bending; and a second hook (7), configured to fix the soft adhesive strip (54) when it forward bending. The storage clip body is made of an elastic material, and the inner hole (2) and the inner concave buckle (3) are arranged near a middle position of the storage clip main body (1). One end of a half of the storage clip body (1) is pierced out of the inner hole (2), and the inner concave buckle (3) is combined to buckle two walls of the inner hole (2) to prevent rebound and thus forming a closed loop. Combined with a flexibility of the elastic material, it can adapt to various sizes of hanging carriers without easily loosening. This design is separated from a clamping area at a tail end that is clamped through a magnetic force and not affected by each other. Two magnets (4) with strong magnetic are provided at two tail ends of the storage clip body, respectively. After the storage clip is folded in half, south and north poles of the magnets at two ends are opposite to each other, and a clamping force is achieved through a magnetic adsorption; at the same time, a local protrusion is added on a clamping surface to enhance an anti-slip effect and improve a firmness of storing a brim of a hat. Besides that, the soft adhesive strip (5) is provided in the middle position of the storage clip after the storage clip is folded in half, one end of the soft adhesive strip (5) is fixed to the storage clip body (1) with the first hook (6), and the other end the soft adhesive strip is provided with multiple through holes with different spacings from the first hook (6). When it is necessary to store glasses, the soft adhesive strip (5) is reverse bent to wrap a glasses bracket, and the through holes at the tail end are buckled into the first hook (6) for fixation, thereby achieving a function of storing glasses when it is not in use. The design of through holes with different spacings is used to meet requirements of different sizes of glasses brackets. This design enhances a traditional function of the hat clip, achieves multiple functions, and extends applicability in various scenarios. When the soft adhesive strip (5) is not in use, through holes at the tail end of the soft adhesive strip (5) are used to forward buckle into the second hook (7) for fixation, which is more aesthetically in a whole and convenient for carrying the storage clip when going out.

The above embodiments are only used to illustrate the technical solution of the present disclosure, not to limit it. Under a concept of the present disclosure, the technical features in the above embodiments or different embodiments can also be combined, and the steps can be implemented in any order. There are many other changes in different aspects of the present disclosure as described above, which are not provided in detail for simplicity. Although the present disclosure has been described in detail with reference to the above embodiments, ordinary technical personnel in the art should understand that they can still modify the technical solutions recorded in the above embodiments or equivalently substitute some of the technical features; and these modifications or substitutions do not separate the essence of the corresponding technical solutions from the scope of the technical solutions of the various embodiments of the present disclosure.

What is claimed is:

1. A multifunctional storage clip, comprising:

a storage clip body with opposing tail ends;

an inner hole located proximate a middle area of the storage clip body;

an inner concave buckle symmetrically arranged with the inner hole;

a magnetic magnet wrapped inside each tail end of the storage clip body;

a soft adhesive strip provided on an exterior surface of the storage clip body;

a first hook configured to fix the soft adhesive strip in a reverse bending position; and a second hook configured to fix the soft adhesive strip in a forward bending position.

2. The multifunctional storage clip according to claim 1, wherein, one end of the soft adhesive strip is fixed to the storage clip body with the first hook, and an opposite end of the soft adhesive strip is provided with multiple through holes with different spacings from the first hook, in a condition of storing glasses, the soft adhesive strip is reverse bent to wrap a bracket of the glasses, and the through holes at the opposite end are buckled into the first hook for fixation.

3. The multifunctional storage clip according to claim 2, wherein the through holes at the opposite end of the soft adhesive strip are used to buckle forward into the second hook for fixation without using the soft adhesive strip.

4. The multifunctional storage clip according to claim 1, wherein the storage clip body is made of an elastic material, and the storage clip body is capable of being folded in half.

5. The multifunctional storage clip according to claim 4, wherein one end of a respective said half of the storage clip is pierced out of the inner hole and two walls of the inner hole are buckled by the inner concave buckle to prevent rebound and thus forming a closed loop when in use.

6. The multifunctional storage clip according to claim 5, wherein two ends of the tail end of the storage clip body are wrapped with the magnetic magnet, respectively, south and north poles of the magnetic magnet at two ends are opposite to each other, the magnets are magnetically adsorbed together to achieve a clamping force by magnetic force to clamp a brim of a hat or magnetically clamp and hang the hat after passing through a hat buckle when the storage clip body is pierced out and folded.

7. The multifunctional storage clip according to claim 6, wherein an outer surface of each tail end of the storage clip body that is wrapped with the magnetic magnet is provided with a local protrusion.

* * * * *